United States Patent [19]

Lyons

[11] 4,104,761

[45] Aug. 8, 1978

[54] MOUNTING MEANS FOR DOOR-CHECK FOR TORSIONALLY BALANCED HATCHWAY DOOR

[76] Inventor: Robert J. Lyons, 1060 Ridge Rd., Hamden, Conn. 06514

[21] Appl. No.: 815,362

[22] Filed: Jul. 13, 1977

[51] Int. Cl.[2] ..... E05F 3/00; E05F 5/10

[52] U.S. Cl. ..... 16/84; 16/51

[58] Field of Search ..... 16/54, 68, 135, 180, 16/49, 51, 84; 49/137; 228/334; 188/272

[56] References Cited

U.S. PATENT DOCUMENTS

| | | | |
|---|---|---|---|
| 3,058,146 | 10/1962 | Harrison | 16/84 |
| 3,067,453 | 12/1962 | Lyons | 16/180 |

FOREIGN PATENT DOCUMENTS

| | | | |
|---|---|---|---|
| 1,118,310 | 6/1968 | United Kingdom | 16/84 |

*Primary Examiner*—Ronald Feldbaum

*Attorney, Agent, or Firm*—St. Onge, Mayers, Steward & Reens

[57] ABSTRACT

Mounting means for a door-check for a hatchway door hinged to swing between an elevated open position and a closed position and having torsion bars which serve not only as springs for counterbalancing the weight of the door, but also as the hinge pins for the door. Each torsion bar has a terminal portion which is bent backwardly into parallel relation with a straight portion, the terminal portion extending through the hinge and forming the hinge pin. The straight portion is secured at its other end to the hatchway frame and is twisted about the terminal portion by the hinge as the door is closed. The door-check member is mounted on the hatchway frame and is connected to a bracket mounted across the crook formed in the torsion bar where the terminal portion bends backward. The bracket therefore pivots about the hinge pin with the main portion of the torsion bar when the door is closed and provides a crank arm for actuating the door-check.

4 Claims, 3 Drawing Figures

FIG. 1
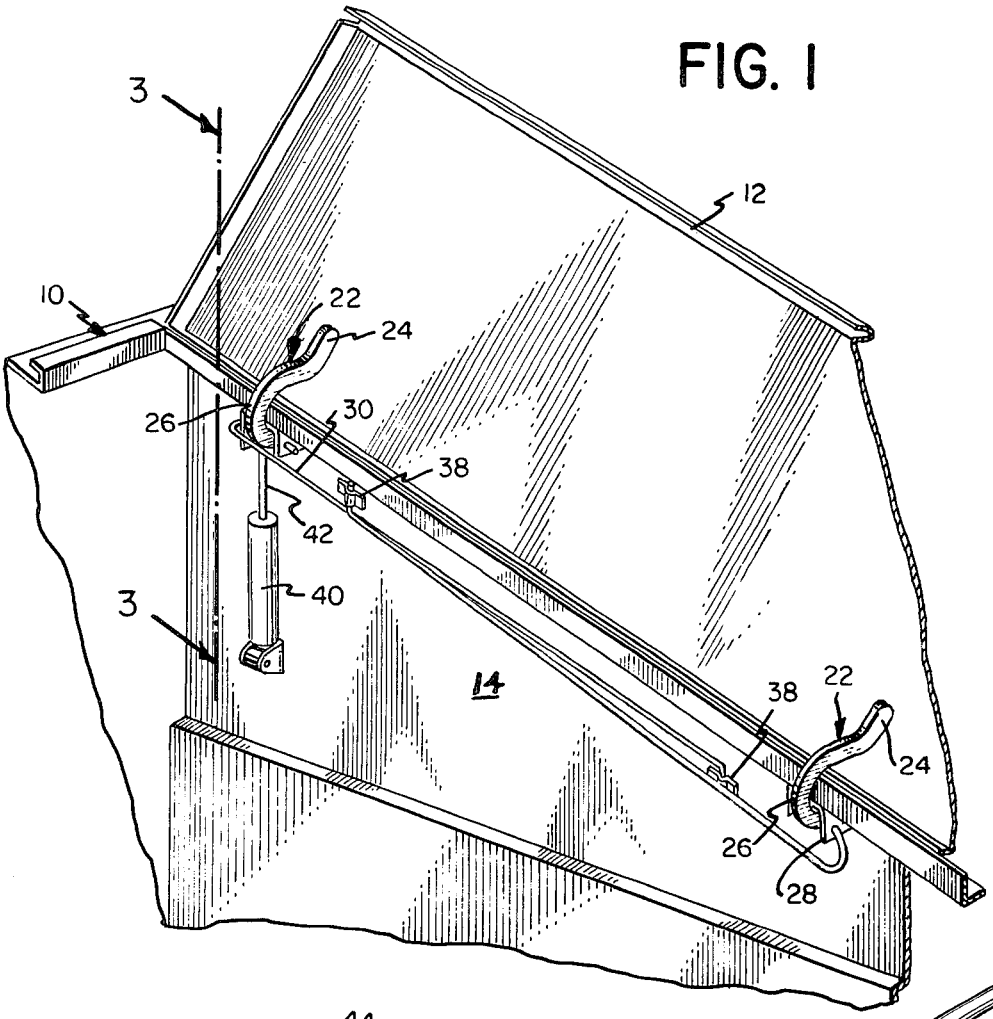
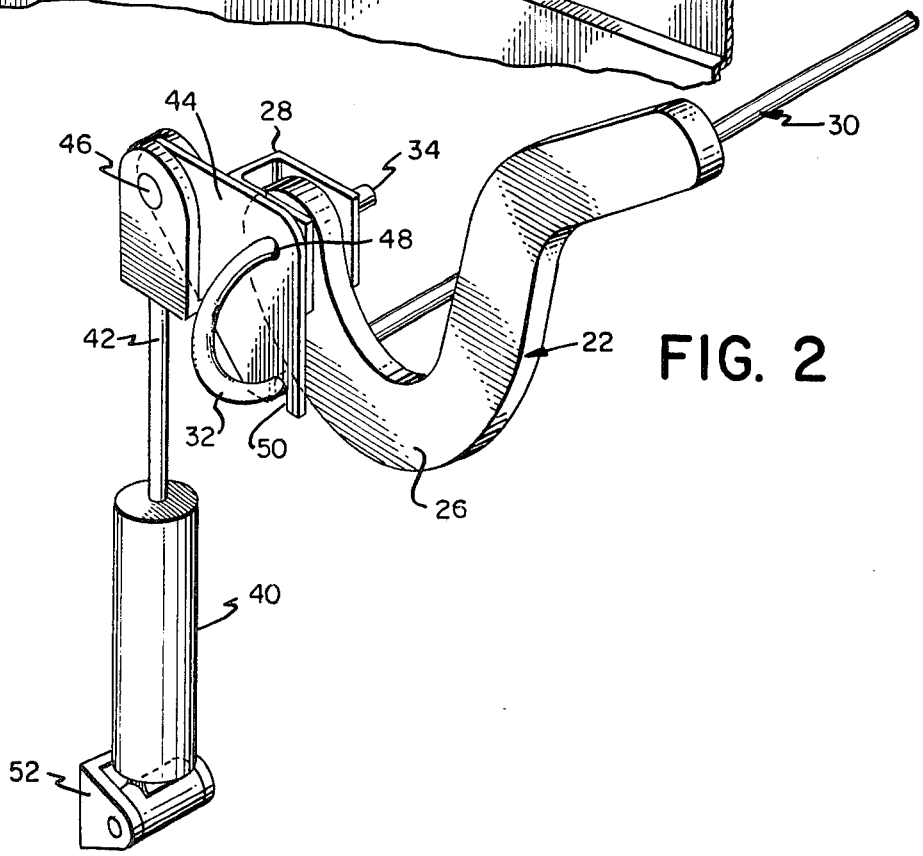
FIG. 2

MOUNTING MEANS FOR DOOR-CHECK FOR TORSIONALLY BALANCED HATCHWAY DOOR

BACKGROUND OF THE INVENTION

The present invention relates to torsionally balanced hatchway closures, and it relates more particularly to the provision of a fluid check device for yieldingly resisting movement of the door to the closed position.

In my prior U.S. Pat. No. 3,067,453 I disclosed a torsionally balanced hatchway closure in which a pair of torsion bars perform the dual function of providing the counterbalancing force which facilitates controlling the movement of the door when it is opened and closed, and of pivotally hinging the door to the hatchway frame. The torsion bars of such prior construction are each formed with a straight portion that forms the major part of the bar and a terminal portion that is bent backward on the straight portion thereby forming a crook at the end of the bar. The terminal portion is inserted through the hinge members and forms the hinge pin therefor, the straight portion being disposed adjacent a gooseneck part of the hinge so that it is pivoted by the gooseneck about the axis of the hinge as the door is closed, thereby twisting the torsion bar. It has been found that in some cases it is desirable to supplement the action of the torsion bars with a door-check type of device, so that when the door is pushed toward the closed position its motion is slowed or stopped before it can slam closed, thereafter permitting the door to be lowered slowly into fully closed position.

An object of this invention is to provide a simple and inexpensive way of mounting such a door-check device in hatchway closures which are torsionally balanced in the manner disclosed in my abovementioned prior patent.

SUMMARY OF THE INVENTION

A bracket is mounted on at least one of the torsion bars for each door at its crook between the terminal and straight portions thereof, so that it pivots with the straight portion about the axis of the hinge. A fluid check member, which may desirably be a pneumatic or hydraulic shock-absorbing cylinder, is mounted on the frame member to which the door is hinged and has its actuating member connected to the aforesaid bracket at a point spaced from the hinge axis in such a way that it is driven against the resistance of the check member as the door is closed.

An advantage of the invention is that it employs the crook of the existing torsion bar for actuating the shock absorber and does not require any change in the original design. Moreover, the components can be supplied as a packaged kit in knocked-down form for simplified shipping, yet is easily assembled on-site by a foundation contractor or builder during erection of a new hatchway, or by a homeowner on a previously installed one, all without special tools. A further advantage of the invention lies in the fact that the shock absorber is mounted at the hinge itself, so that the hatchway has no added obstructions which project into the passage area.

DESCRIPTION OF THE PREFERRED EMBODIMENT

In the drawings

FIG. 1 is a fragmentary perspective view of one side of a torsionally balanced cellar hatchway with a fluid check cylinder in accordance with the invention;

FIG. 2 is a detail view in perspective, showing the way in which the fluid check cylinder is connected to the torsion bar, the assemblage being viewed from the other side of the hinge shown in FIG. 1.

Figure 3:
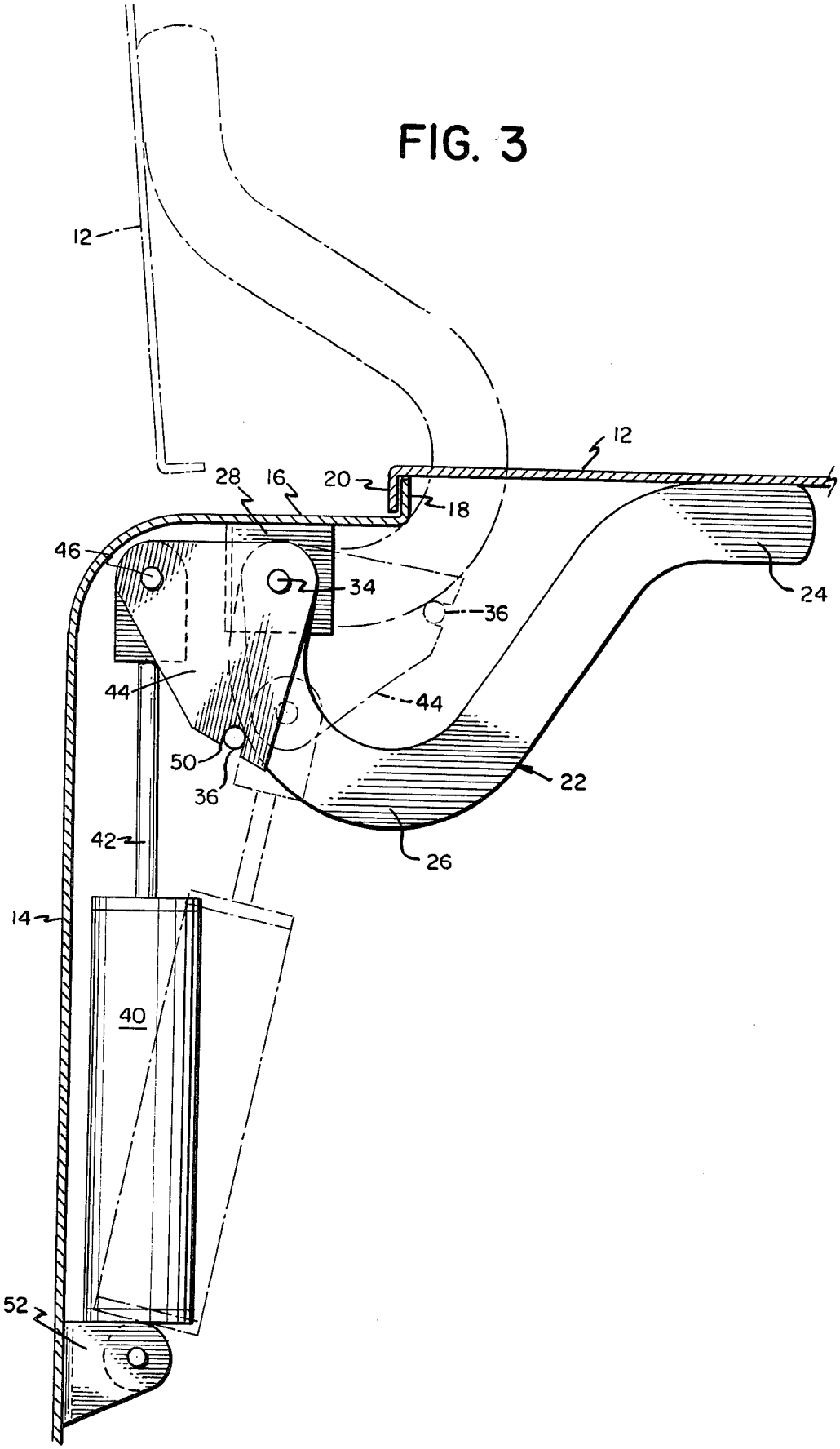
FIG. 3 is a vertical cross-section on a larger scale substantially along the line 3—3 of FIG. 1.

The hatchway cover construction generally comprises a hatchway frame 10 having a door 12 hinged to one of the longitudinal edges of the frame and adapted to swing from the elevated open position shown in FIG. 1 down to a closed position across the opening in frame 10 in which it abuts another door (not shown) hinged to the opposite side of the opening. The side panels 14 of frame 10 are triangular in shape in order to incline the hinge line of the doors to the horizontal. Each panel 14 is formed along its upper edge with an inwardly directed flange portion 16 (FIG. 3), the inner edge of which is provided with an upstanding lip 18. Door 12 is provided with an inwardly projecting lip 20 along its hinged edge which overlaps and seals with lip 18 on the frame when the door is closed.

Door 12 is mounted on the frame by means of a pair of spaced hinge straps 22, each of which has a base portion 24 by which it is suitably secured to the door and a gooseneck portion 26. Suitable hinge brackets 28 are mounted on the underside of flange 16 of the frame in alignment with hinge straps 22 on the door. As best shown in FIG. 2, each of the hinge pins for the doors is formed by an integral part of an elongate torsion rod or bar 30, which has a crook 32 at one end providing a short terminal leg 34 directed backwardly, substantially parallel with the straight portion 36 that forms the major part of the bar. The short leg 34 of each torsion bar 30 passes through one of the hinge straps 22 and bracket 28 therefor, thereby pivotally supporting the door 12 on frame 10.

As shown in FIG. 1 the opposite end of each torsion bar 30 is held securely to side panel 14 by a strap 38, through which a right-angle bend at this end of bar 30 extends in order to positively prevent rotation of that end of the bar.

As fully described in my hereinbefore-mentioned U.S. Pat. No. 3,067,453, the torsion bars 30 serve not only as hinge pins for the doors, but also as torsion springs for counterbalancing the weight of the doors as they are moved to closed position. To this end, the crook portion 32 of each bar 30 forms a crank arm in which the straight section 36 of the crook is engaged by the back edge of the gooseneck portion 26 of hinge strap 22, so that as the door closes, the section 36 is cranked around the short terminal leg 34, thereby twisting the bar and setting up torsional stresses which counteract the movement of the door to its closed position.

Since the counterbalancing force of torsion bars 30 should only be sufficient to facilitate lifting the door from its closed position, any unrestrained external force exerted on the door in the direction of closing it can result in the door slamming closed. For example, if the door is pushed closed by hand without holding it, nothing prevents the door from closing with a slam. The problem heretofore in providing a conventional pneumatic or hydraulic shock absorber to prevent such unrestrained closing action of hatchway doors has been that there seemed to be no practical way of mounting a shock-absorber between the door and frame of the hatchway without unduly obstructing the passage.

However, in accordance with the present invention, a shock-absorbing cylinder 40 is mounted so that its piston rod 42 is actuated by the crank arm formed by the crook 32 of torsion bar 30. To this end, a flat delta-shaped bracket 44 is mounted on the crook of bar 30 between its terminal portion 34 and its straight portion 36 for pivotal movement with the torsion bar about the axis of the door hinge. Piston rod 42 is connected to bracket 44 by a pivot pin 46 located in spaced relation to hinge pin 34 at a point which will produce maximum movement of the piston rod as the door approaches its fully closed position. Accordingly, pin 46 is disposed such that when door 12 is closed, the lever-arm between pin 46 and hinge pin 34 extends substantially perpendicular to piston rod 42, as shown in full lines in FIG. 3.

Bracket 44 is desirably a flat metal stamping or plate provided with a hole 48, through which hinge pin 34 is inserted before being inserted into hinge bracket 28 and strap 22. A notch 50 is formed in one edge of bracket 44 to receive the straight portion 36 of torsion bar 30. In this way notch 50 can be placed over the portion 36 of torsion bar 30 before the hole 48 is slipped onto the end of terminal portion 34, thereby avoiding the necessity of sliding bracket 44 all the way around the crook 32, as would be necessary if a closed hole were provided instead of the notch 50. It will be understood, however, that the provision of a notch in lieu of a hole is not essential.

Cylinder 40 is mounted at its lower end on a pivot bracket 52 suitably secured as by welding to the adjacent side panel 14 of hatchway frame 10. By locating pin 46 to the outside of pivot pin 34 (i.e. toward side panel 14) as shown in full lines in FIG. 3, piston rod 42 is pulled outward to its extended position when door 12 is moved toward its closed position. Cylinder 40 is accordingly selected so that it functions to resist extension of piston rod 42, particularly during the final increment of movement of door 12 into its fully closed position.

It will be noted that by mounting the shock-absorbing piston 40 in this manner, it is disposed next to side panel 14 under the flange lip 16 of the hatchway frame 10 where it is completely out of the way and does not obstruct the opening through the hatchway. Moreover, it provides a very simple and inexpensive way of preventing the door from slamming closed.

It will also be apparent that the door-check device of the present invention is eminently suited for installation by do-it-yourselfers using simple hand tools. Thus, instead of welding bracket 52 to the side panel 14, holes can be prepunched and bolts furnished with the door-check kit so that no welding is required.

Although specific embodiments of the present invention have been described above in detail, it is to be understood that these are for purposes of illustration. Modification may be made to the described embodiments of the invention by those skilled in the art for particular applications.

What is claimed is:

1. In a torsionally balanced hatchway door construction having a hatchway frame, a door hinged thereto for movement between an elevated open position and a closed position, a torsion bar for counterbalancing the weight of said door, said torsion bar having a straight portion with said terminal portion forming a hinge pin for the door and said straight portion being pivoted about the hinge axis in one direction when said door is swung to its closed position, and a fluid check member for yieldingly resisting swinging movement of the door to its closed position, means for mounting said fluid check member comprising a bracket mounted on said torsion bar between said terminal and straight portions for pivotal movement therewith about said hinge axis, said fluid check member being mounted on said hatchway frame and having an actuating element connected to said bracket at a point spaced from said hinge axis such that said actuating element is driven by the pivotal movement of said bracket against the resistance of said check member as the door is closed.

2. Mounting means as defined in claim 1, wherein said fluid check member comprises an elongate cylinder pivotally connected at one end to said hatchway frame, said actuating element comprising the piston rod of said cylinder.

3. Mounting means as defined in claim 2, wherein said piston rod is connected to said bracket at a pivot point such that pivotal movement of the straight portion of said torsion bar in said one direction draws said piston rod outwardly into an extended position, the lever arm between said pivot point and said hinge pin being generally perpendicular to the longitudinal axis of said piston rod when said door is in its closed position.

4. Mounting means as defined in claim 1, wherein said bracket comprises a plate having a hole through which the terminal portion of said torsion bar extends and a notch in the edge of said plate for receiving the straight portion of said torsion bar.

* * * * *